US006079116A

United States Patent [19]

Jewitt et al.

[11] Patent Number: 6,079,116

[45] Date of Patent: Jun. 27, 2000

[54] DUCT CONFIGURATION FOR A THROUGH-AIR DRYING APPARATUS IN A PAPERMAKING MACHINE

[75] Inventors: Dennis Edward Jewitt, Kent, United Kingdom; Sven Sören Eriksson, Skattkärr, Sweden; Richard Alan Parker, Cape Elizabeth, Me.

[73] Assignee: Valmet-Karlstad AB, Sweden

[21] Appl. No.: 09/187,954

[22] Filed: Nov. 6, 1998

[51] Int. Cl.[7] ..... F26B 11/02

[52] U.S. Cl. ..... 34/115; 34/122; 34/130

[58] Field of Search ..... 34/114, 115, 116, 34/117, 120, 123, 454, 457, 113, 119, 124, 125, 121, 130; 162/206, 209, 359.1, 375, 207, 290

[56] References Cited

U.S. PATENT DOCUMENTS

| | | | |
|---|---|---|---|
| 3,303,576 | 2/1967 | Sisson | 34/115 |
| 3,432,936 | 3/1969 | Cole et al. | 34/6 |
| 3,762,067 | 10/1973 | Whittaker et al. | 34/201 |
| 3,808,846 | 5/1974 | Fleissner | 68/19.1 |
| 4,096,643 | 6/1978 | Futcher | 34/122 |
| 4,103,434 | 8/1978 | Walker | 34/114 |
| 4,268,974 | 5/1981 | Price | 34/86 |
| 4,328,626 | 5/1982 | Lietner | 34/115 |
| 4,462,868 | 7/1984 | Oubridge et al. | 162/280 |
| 4,523,390 | 6/1985 | McCarthy | 34/115 |
| 4,536,970 | 8/1985 | Eskelinen | 34/41 |
| 4,706,391 | 11/1987 | Urbas | 34/114 |
| 4,758,310 | 7/1988 | Miller | 162/359 |
| 5,022,163 | 6/1991 | Ilvespaa et al. | 34/23 |
| 5,146,696 | 9/1992 | Mayer et al. | 34/117 |
| 5,255,447 | 10/1993 | Christ | 34/114 |
| 5,383,288 | 1/1995 | Ilmarinen et al. | 34/392 |
| 5,416,979 | 5/1995 | Joiner | 34/114 |
| 5,465,504 | 11/1995 | Joiner | 34/446 |
| 5,495,678 | 3/1996 | Ilmarinen et al. | 34/117 |
| 5,515,619 | 5/1996 | Kahl et al. | 34/114 |
| 5,546,675 | 8/1996 | McGraw et al. | 34/113 |
| 5,553,392 | 9/1996 | Hanaya | 34/115 |
| 5,575,084 | 11/1996 | Vuorinen | 34/460 |
| 5,647,141 | 7/1997 | Hanaya | 34/115 |
| 5,653,041 | 8/1997 | Ilmarinen et al. | 34/117 |
| 5,666,740 | 9/1997 | Leinonen et al. | 34/114 |
| 5,678,321 | 10/1997 | Deshpande et al. | 34/115 |
| 5,738,760 | 4/1998 | Svanqvist et al. | 162/193 |
| 5,771,602 | 6/1998 | Heikkila et al. | 34/420 |
| 5,784,804 | 7/1998 | Nowakowski | 34/446 |
| 5,915,813 | 6/1999 | Joiner | 34/115 |
| 5,937,538 | 8/1999 | Joiner | 34/122 |
| 5,992,040 | 11/1999 | Nordang | 34/114 |
| 6,003,241 | 12/1999 | Komulainen et al. | 34/117 |
| 6,003,245 | 12/1999 | Lipponen et al. | 34/457 |
| 6,006,444 | 12/1999 | Baubock et al. | 34/463 |

*Primary Examiner*—Denise L. Ferensic
*Assistant Examiner*—Andrea M. Joyce
*Attorney, Agent, or Firm*—Alston & Bird LLP

[57] ABSTRACT

A through-air drying apparatus for drying a traveling wet paper web supported on a continuous fabric comprises a dryer roll about which the fabric and web are partially wrapped and which has a foraminous roll face, a supply hood which surrounds the portion of the roll about which the fabric and web are wrapped and which supplies heated air through the fabric and web and through the roll face into the interior of the roll, and an exhaust system for exhausting air from the roll. An axial exhaust passage is formed through at least one head of the roll. An exhaust manifold is connected to the exhaust passage and defines two outlets on opposite sides of the manifold. A pair of movable ducts are sealingly and releasably engaged with the outlets in the opposite sides of the manifold, the ducts being spaced apart on opposite sides of the roll so that an access space is defined between the two ducts for access to the roll and supply hood. The movable ducts are pivotally connected to fixed ducts by bendable bellows sections of the movable ducts and by hinges. The movable ducts pivot about axes parallel to the rotation axis of the dryer roll such that the ducts extend axially beyond the roll by about the same axial extent in both the open and closed positions. The duct system is also suitable for supplying air to the interior of a roll in an outward-flow type of through-air drying apparatus.

28 Claims, 3 Drawing Sheets

DUCT CONFIGURATION FOR A THROUGH-AIR DRYING APPARATUS IN A PAPERMAKING MACHINE

FIELD OF THE INVENTION

The present invention relates to an apparatus for drying a traveling wet paper web by passing heated air through the web and through a foraminous surface of a roll around which the web is wrapped as it passes through the apparatus.

BACKGROUND OF THE INVENTION

In many paper making machines, through-air dryers (TADs) are used for effecting evaporative drying of the web either after or instead of pressing devices. Typically a TAD unit includes a hollow rotatable drying roll having a porous cylindrical roll face around which the wet web of paper is partially wrapped as the web is passed through the device. The web is typically supported on a continuous fabric as it is passed through the TAD unit. Heated air passes through the porous roll face and through the web and fabric so as to cause evaporative drying of the web. For reasons of energy efficiency, the heated air may be recovered after it has passed through the web and a substantial portion of the recovered air recirculated back through a heating device where it is reheated and passed back through the porous roll face and the web and fabric.

Because the fabric and web cannot be wrapped a full 360° 0 around the drying roll, in all rotary TAD units there is an inactive sector or dead zone of the drying roll which the fabric and web do not contact. In some TAD units, for example as shown in U.S. Pat. No. 3,303,576, heated air under pressure is supplied to the interior of the roll through the porous roll face in the dead zone and the heated air passes radially outwardly through the porous roll face and through the fabric and web along the active portion of the roll. In this type of TAD unit, the paper web may contact the drying roll and the supporting fabric is on the outer surface of the web. The air after passing through the web is recovered by an exhaust hood which surrounds the active portion of the roll. However, in dryers employing such radially outward flowing drying air, the pressure differential across the web, and hence the air flow and drying capacity, are limited by the fabric tension. Additionally, the supply ducting which passes the heated air through the roll face into the roll interior takes up space adjacent the roll surface and thus conflicts with the objective of maximizing the circumferential extent (i.e., the "wrap angle") of the drying roll about which the web and fabric are wrapped. It is desirable to maximize the wrap angle so as to maximize the drying area and hence the time during which a given portion of the web is on the drying roll. Furthermore, the supply ducting increases the overall height of the TAD unit and thus conflicts with the objective of minimizing the overall height of the TAD unit.

Another type of TAD unit is exemplified in U.S. Pat. No. 3,432,936, wherein the heated air is supplied under moderate pressure to a supply hood which surrounds the active portion of the drying roll, and the heated air is drawn by the exhaust system from the supply hood through the web and fabric and through the porous roll face of the drying roll into the roll interior. In some of the embodiments disclosed in the '936 patent, air is exhausted from the interior of the drying roll through the porous roll face in the dead zone of the roll and into an exhaust plenum which is sealed against the roll face in the dead zone. In such an arrangement, the exhaust plenum conflicts with maximizing the wrap angle of the web, as noted above for the supply duct of the '576 patent. Furthermore, in this configuration, the exhaust ducting increases the overall height of the TAD unit and thus conflicts with the objective of minimizing the height of the TAD unit. The '936 patent also discloses embodiments in which air is exhausted axially through one end wall or head of the drying roll and is routed axially away from the roll by a duct. However, such axial ducts increase the overall axial length of the TAD unit. Also known are TAD units in which air is exhausted axially out both ends of the dryer roll.

In addition to the objectives of maximizing the wrap angle and minimizing the overall height and length dimensions of a TAD unit, it would also be desirable to provide a TAD unit enabling access to the hoods, dryer roll, and the associated guide rolls which guide the continuous fabric (also known in the industry as "clothing") about the dryer roll, so that debris can be removed from the hoods. In an inward-flow TAD unit having hoods located beneath the roll, access to the lower part of the hoods is especially desirable as paper may lodge in the area as a result of process upsets. Additionally, the fabric must be removed and replaced periodically, and thus it is desirable to be able to slip a new continuous fabric axially over the end of the roll. Split hoods formed in two halves which can be moved away from each other and away from the roll have been developed to facilitate access to the internal areas of the hoods and to the dryer roll for inspection and fabric changing purposes. However, a continuing problem with TAD units in which air is directed via ducts axially through the head at the tending side of the roll is the need to be able to disconnect the ducting to gain access to the dryer roll for fabric changing.

TAD units with duct sections that are entirely removable have been developed to provide the needed access to the dryer roll, but such removable ducts tend to be large and unwieldy. Furthermore, removing and replacing a duct section necessitates breaking and re-establishing seals at both ends of the duct section every time a fabric is changed.

An alternative solution to the access problem which has been used in some TAD units of the inverted hood type in which the hood is located essentially beneath the dryer roll is to route the air duct above the dryer roll from the "tending side" of the dryer roll (i.e., the side of the machine opposite from the drive side where the drive motor is located) axially to the drive side of the machine. However, this duct arrangement has its own disadvantages. Specifically, if the duct passes close to the surface of the dryer roll, it tends to interfere with maximizing the wrap angle of the web about the roll; conversely, if the duct is well above the roll surface, the overall height of the machine increases. Additionally, such axially routed ducts tend to be long, creating greater pressure losses in the system.

SUMMARY OF THE INVENTION

The above needs are met and other objects and advantages are achieved by the present invention, which provides a through-air drying apparatus having an axial duct system that enables access to the apparatus for inspection and fabric changing. In the case of an outward-flow through-air drying apparatus, the axial duct system of the invention comprises an axial supply system or inlet system for the drying air. Alternatively, in the case of an inward-flow through-air drying apparatus, the axial duct system of the invention comprises an axial exhaust system for removing air from the interior of the roll after it has passed through and dried the web. In preferred embodiments of the invention, the axial duct system allows access to the hood and drying roll while at the same time not substantially affecting the overall height and length of the apparatus. Additionally, long duct runs are avoided.

To these ends, a preferred embodiment of a through-air drying apparatus in accordance with the invention includes a rotatable roll having a foraminous tubular roll face encircling a rotation axis of the roll and adapted to have the web wrapped about a circumferentially extending portion thereof, and first and second heads attached to opposite ends of the roll so as to enclose an interior space within the roll. An axial air passage is formed through the first head of the roll. The apparatus also includes a hood surrounding the active portion of the roll and adapted to seal against the roll face such that air flows between the hood and the interior of the roll without substantial leakage. A duct system is connected to the roll for directing air flow through the web on the roll. The duct system includes a pair of ducts fluidly coupled to the axial air passage in the first head of the roll, the ducts having elongate portions proximate the first head of the roll which extend generally transverse to the rotation axis of the roll and which are spaced apart from each other on opposite sides of the rotation axis such that an access space is defined between the ducts for access to the supply hood and active portion of the roll.

In a preferred embodiment of the invention, the through-air drying apparatus comprises an inward-flow apparatus in which air is supplied from the hood through the web and fabric and through the roll face into the interior of the roll, and the duct system comprises an axial exhaust system. The exhaust system advantageously includes an exhaust manifold connected to the exhaust passage and located proximate the first head of the dryer roll. The exhaust manifold defines a pair of outlets and each of the exhaust ducts engages one of the outlets so as to fluidly couple the exhaust ducts to the exhaust manifold.

The exhaust system preferably includes a pair of spaced-apart fixed ducts each having an open end spaced from one of the outlets of the exhaust manifold, and each of the exhaust ducts is connected at one end thereof to one of the fixed ducts. The other ends of the exhaust ducts are connected to the outlets of the exhaust manifold. At least the connections at the ends of the exhaust ducts that connect with the exhaust manifold are releasable so that those ends of the exhaust ducts can be moved away from the exhaust manifold. The exhaust ducts are pivotable and/or slidable for effecting such movement. In a preferred embodiment of the invention, the exhaust ducts connect to the fixed ducts at pivotal connections so that the exhaust ducts are pivotable between closed positions fluidly connecting the fixed ducts to the exhaust manifold and open positions in which the manifold-engaging ends of the exhaust ducts are moved away from the exhaust manifold and the roll so as to facilitate access to the supply hood and active portion of the roll. As an alternative to pivotable ducts, the exhaust ducts instead may be slidable or translatable by a suitable mechanism such as wheels guided in a track or the like, in which case the connections between the exhaust ducts and the fixed ducts are also releasable to permit the exhaust ducts to translate.

Advantageously, each exhaust duct pivots or translates in a plane generally perpendicular to the rotation axis of the roll, such that the ducts extend axially beyond the roll by about the same axial extent in both the open positions and the closed positions. Accordingly, the overall axial dimension of a space in which the apparatus is installed can be minimized.

In a preferred embodiment of the invention, the apparatus includes a pair of actuators each connected to one of the exhaust ducts, the actuators being operable to move the exhaust ducts between the open and closed positions. Various types of actuators can be used, including jack screws, hydraulic, electric, or pneumatic actuators, or equivalent devices.

Preferably, each exhaust duct includes a bendable portion facilitating pivotal movement of the exhaust duct. The bendable portions advantageously comprise bellows. The bendable portions are advantageously located proximate the ends of the exhaust ducts which are connected to the fixed ducts.

In some applications an adequate exhaust duct flow area can be provided by a single exhaust duct connected to the exhaust passage in the first head of the dryer roll. Accordingly, the invention also encompasses a through-air drying apparatus having an exhaust system comprising an exhaust manifold connected to the exhaust passage and defining an outlet proximate the first head, a fixed duct having an open end spaced from the outlet of the exhaust manifold, and a movable duct having one end pivotally connected to the fixed duct and an opposite end which in a closed position of the duct releasably engages the outlet in the exhaust manifold. The movable duct is pivotable between the closed position and an open position in which the free end of the movable duct is moved away from the exhaust manifold and the roll so as to facilitate access to the roll.

It will thus be appreciated that the invention provides various through-air drying apparatus in which the exhaust ducts do not hinder access to the supply hood and active portion of the roll, and/or apparatus in which exhaust ducts are readily moved away from the roll to enable access to the roll for changing fabric, inspection, and the like. The movable duct in accordance with the invention requires that a seal be broken and re-established at only one end of the duct. The invention also facilitates utilization of relatively short exhaust ducts by eliminating the need to pass the ducts axially over the roll to an opposite side of the apparatus.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
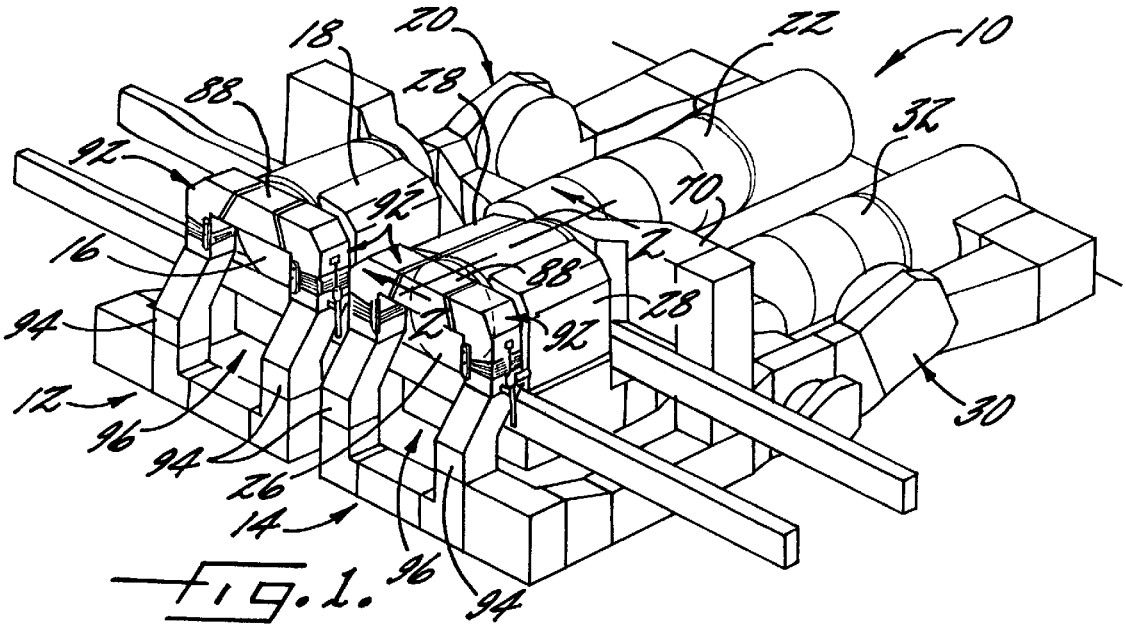
FIG. 1 is a perspective view of a through-air drying apparatus in accordance with one preferred embodiment of the present invention, the apparatus having two TAD units in series.

With reference to FIG. 1, a through-air drying apparatus in accordance with a preferred embodiment of the present invention is broadly designated by the reference numeral 10. The apparatus 10 includes a first TAD unit 12 and a second TAD unit 14 which are arranged in series so that a wet paper web is first passed through the first TAD unit 12 and then through the second TAD unit 14. It will be understood that in FIG. 1, the web-handling system and the continuous fabric routing system are not shown so that the air-handling duct systems can more readily be seen. It will also be appreciated that although the apparatus 10 includes two TAD units, an apparatus in accordance with the present invention may have only one TAD unit, or more than two TAD units.

The first TAD unit 12, or "pre-dryer", comprises a hollow rotatable dryer roll 16, a supply hood 18 which surrounds an active portion of the dryer roll 16 for supplying heated air through the roll face of the roll, and an exhaust system 20 which exhausts air from the interior of the dryer roll 16 through both heads of the roll and recirculates the air back through a heater 22 from which the air is delivered to the supply hood 18.

Figure 3:
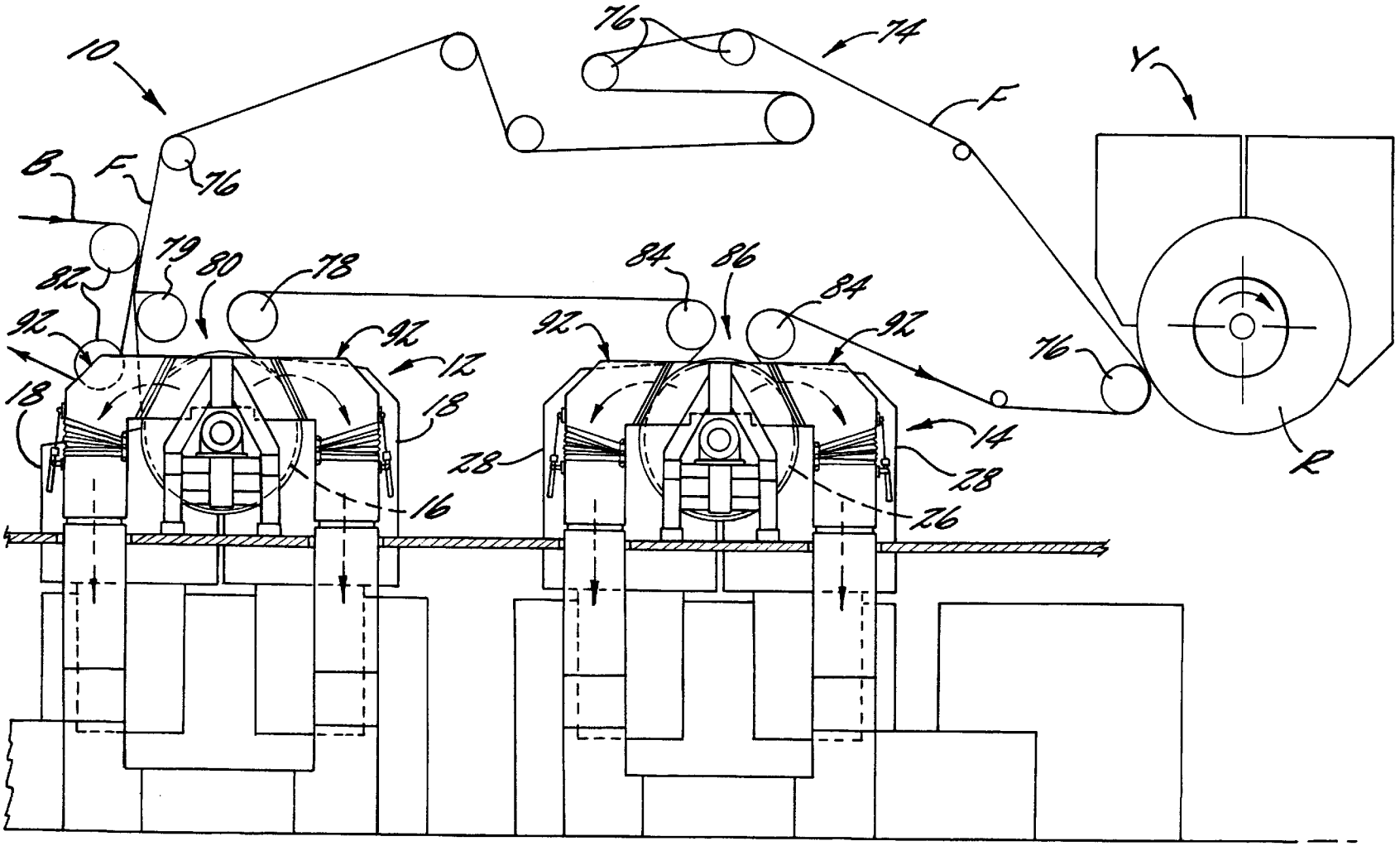
FIG. 3 is an end elevation of the tending side of the apparatus of FIG. 1, also schematically showing a continuous fabric wrapped about the two dryer rolls and guided by guide rolls about a continuous loop, and a Yankee dryer downstream of the TAD units.

Similarly, the second TAD unit 14, or "after-dryer", comprises a hollow rotatable dryer roll 26, a supply hood 28 which surrounds an active portion of the dryer roll 26 for supplying heated air through the roll face of the roll, and an exhaust system 30 which exhausts air from the interior of the dryer roll 26 through both heads of the roll and recirculates the air back through a heater 32 from which the air is delivered to the supply hood system 28. As best seen in FIG. 3, each of the supply hoods 18 and 28 advantageously is formed in two halves that are movable away from each other by a wheeled track or other mechanism (not shown) so that the lower portions of the rolls 16 and 26 can be accessed and so that the interiors of the supply hoods can be inspected and debris removed therefrom if necessary. However, the invention is not limited to TAD units having the supply hood formed in two halves, but also encompasses a TAD unit having a one-piece hood.

Figure 2:
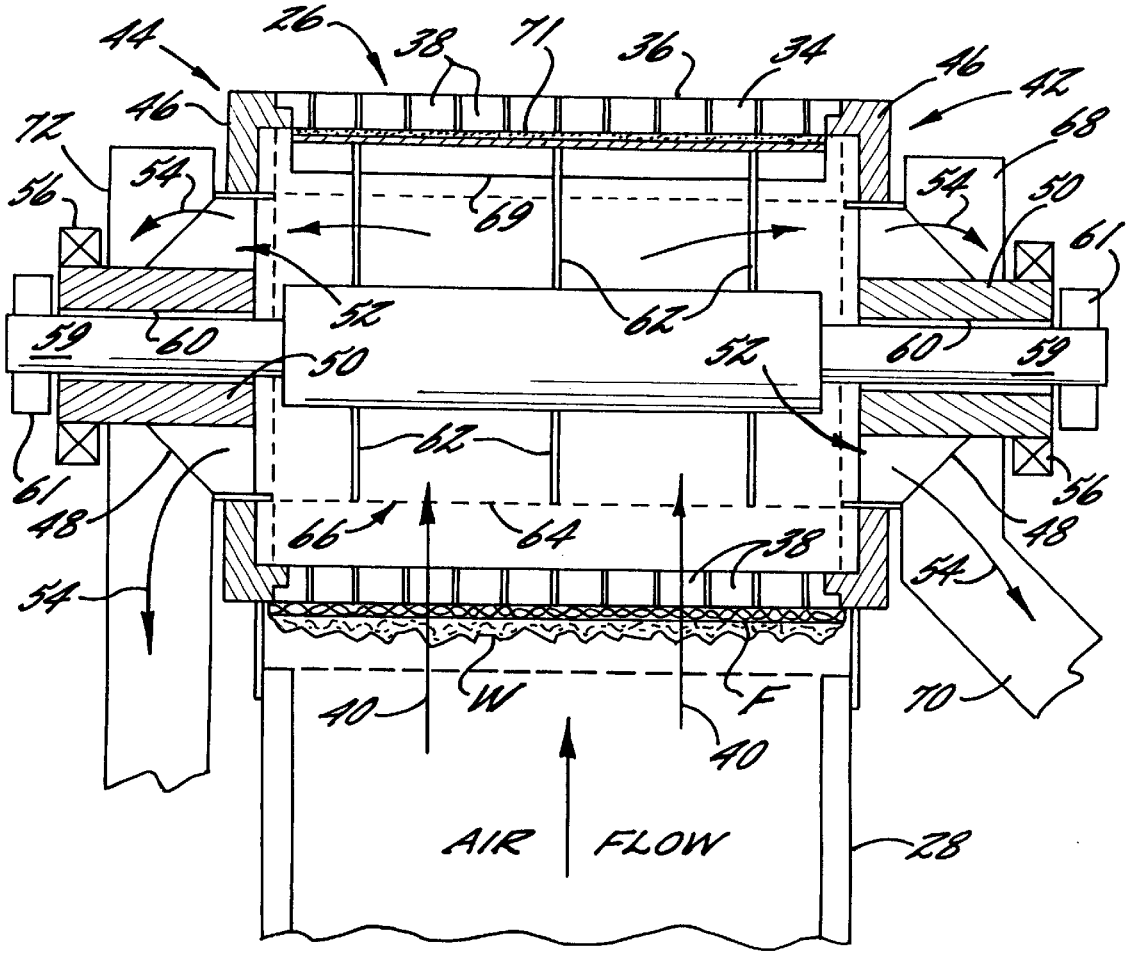
FIG. 2 is a somewhat schematic cross-sectional view taken on line 2—2 of FIG. 1 through the dryer roll of one of the TAD units.

FIG. 2 schematically depicts a cross-sectional view of the dryer roll 26 for the second TAD unit 14; however, it will be understood that the dryer roll 16 of the first TAD unit 12 is substantially similar to the roll 26, and thus the following description applies to both of the rolls 16 and 26. The roll 26 has a foraminous roll face 34 which is adapted to have the wet web W wrapped partially thereabout. The web W is supported by a continuous fabric F which makes contact with the outer surface 36 of the roll face 34. A circumferentially extending active portion of the roll face 34 is surrounded by the supply hood 28 which receives heated air under pressure from the heater 32 (FIG. 1) and directs the air through the web W, the fabric F, and the roll face 34 into the interior of the roll 26. The roll face 34 may be constructed in various ways. One advantageous construction of the roll face 34 is a honeycomb configuration, the cells 38 of the honeycomb defining apertures for the passage of heated air through the roll face 34 into the interior of the roll as indicated by arrows 40.

The roll 26 further includes a pair of end walls or heads 42 and 44 which cover the opposite ends of the roll on the drive side and tending side, respectively. Each of the heads 42 and 44 includes an outer radially extending flange 46 joined at its outer end to the roll face 34. The inner end of each flange 46 is connected by a plurality of circumferentially spaced spoke members 48 to a central annular hub 50. Thus, spaces in between the spoke members 48 collectively define an axial exhaust passage 52 through each head 42, 44 for exhausting air from the interior of the roll 26 as indicated by arrows 54.

Each of the annular hubs 50 is rotatably supported in a bearing 56 so that the roll 26 is rotatable about its central axis. A stationary baffle support tube 58 is disposed concentrically within the interior of the roll 26 and has opposite ends 59 which extend through the central apertures 60 of the hubs 50 and are supported in fixed supports 61. The baffle support tube 58 supports a plurality of radially outwardly extending struts 62. A perforated cylindrical tube 64 is connected to the radially outermost ends of the struts 62. The baffle support tube 58, struts 62, and perforated tube 64 collectively form a distribution tube 66 facilitates a generally uniform air flow through all portions of the web W. Air is prevented from flowing through the dead zone of the roll 26 by a seal plate 69 formed as a portion of a cylindrical shell which is supported by the struts 62 which are extended in length in the dead zone. The seal plate 69 seals against a sector of the inner surface of the roll face 34 with the aid of a seal 71 interposed between the roll face 34 and the seal plate 69.

At the drive side of the roll 26, an exhaust manifold 68 sealingly surrounds the hub 50 at the drive-side head 42 and sealingly engages the flange 46. An exhaust duct 70 is connected to the exhaust manifold 68. Thus, air exhausted through the axial exhaust passage 52 at the drive side passes into the exhaust manifold 68 and from there is exhausted through the exhaust duct 70.

At the tending side of the roll 26, an exhaust manifold 72 sealingly surrounds the hub 50 at the tending-side head 44 and sealingly engages the flange 46. The continuous fabric system and the exhaust system at the tending side are further described now with primary reference to FIGS. 3 and 4. FIG. 3 depicts a tending side elevation of the apparatus 10 showing both TAD units 12 and 14. The apparatus 10 includes a continuous fabric system 74 having a plurality of guide rolls 76 about which a fabric F is looped for guiding the fabric F about a continuous path. The paper web is transferred onto the fabric F from a forming, transfer, or other fabric B which is guided by rolls 82 so that the fabric B becomes tangent to the fabric F at a location just upstream of the first TAD unit 12. A suction member 79 located near the tangent point assists in transferring the web from the fabric B onto the fabric F and then around the drying roll 16. The system of guide rolls 76 includes a guide roll 78 proximate a downstream side of an inactive sector or dead zone 80 (i.e., a sector of the dryer roll 16 not surrounded by the supply hood 18, located generally at the top dead center of the roll 16) of the first TAD unit 12. The roll 78 guides the fabric F and the web supported on the fabric F so that the fabric and web are wrapped about a majority of the circumference of the roll 16. The system of guide rolls for the fabric F also includes a pair of rolls 84 proximate a dead zone 86 of the dryer roll 26 of the second TAD unit 14, the rolls 84 guiding the fabric F and paper web so that they are wrapped about a majority of the circumference of the roll 26. It will also be noted that the fabric F becomes tangent to a rotating dryer roll R of a Yankee dryer Y downstream of the second TAD unit 14, the paper web being transferred onto the roll R and the Yankee dryer Y performing a further drying operation on the paper web after the web exits the through-air drying apparatus 10. However, the invention does not depend on the use of a Yankee dryer and is applicable to through-air drying machines which do not include a Yankee dryer.

Because the exhaust system components at the tending sides of both of the TAD units 12 and 14 are substantially identical, the exhaust system for only the second TAD unit 14 will be described below with primary reference to FIG. 4, it being understood that the description applies equally to the first TAD unit 12. The exhaust manifold 72 at the tending side of the roll 26 includes a portion 88 (also visible in FIG. 1) which is proximate the end of the roll 26 and extends generally perpendicular to the rotation axis of the roll 26. The manifold portion 88 defines two outlets 90 on opposite ends thereof. These outlets 90 are sealingly but releasably engaged by the open ends of a pair of generally elbow-shaped exhaust ducts 92 which receive exhaust air from the manifold portion 88 flowing generally transversely outward in opposite directions away from the roll 26, and which curve downward so that the air is carried generally vertically downward away from the roll 26. Thus, the vertical portions 94 of the ducts 92 are spaced apart from each other on opposite sides of the rotation axis of the roll 26, and preferably are spaced apart by a distance exceeding the diameter of the roll 26 as shown, so that an access space 96 is defined between the duct portions 94 permitting access to the roll 26 for maintenance and inspection purposes.

Each of the ducts 92 includes a movable duct section 98 that is pivotally connected to the corresponding generally vertical duct section 94 which is fixed. The movable duct section 98 includes a bendable portion formed as a bellows 100 which permits the movable duct section 98 to pivot about an axis parallel to the rotation axis of the roll 26 relative to the fixed duct section 94, as can be seen in FIG. 4 by comparing the solid lines depicting the movable ducts 98 in open positions, with the phantom lines depicting the movable ducts 98 in closed positions sealingly engaging the outlets 90 in the exhaust manifold portion 88. The movable ducts 98 are guided to pivot about axes parallel to the roll rotation axis by hinges 102 connected between the movable ducts 98 and the fixed ducts 94 along the inner sides of the ducts facing the roll 26. Because each exhaust duct 98 pivots about a pivot axis that is generally parallel to the rotation axis of the roll, the ducts 98 extend axially beyond the roll 26 by about the same axial extent in both the open and closed positions. Accordingly, the overall axial dimension of a space in which the apparatus 10 is installed can be minimized.

Pivotal movement of the movable ducts 98 is effected by actuators 104. With reference to FIGS. 4 and 5, each actuator 104 comprises a jack screw having a threaded rod 106 pivotally affixed at one end to a bracket 107 which is attached to the movable duct 98. It will be appreciated, of course, that other types of actuators including hydraulic or pneumatic cylinders may be used instead of jack screws. The threaded rod 106 is threaded into a rotatable nut (not visible in the Figures) which is driven to rotate by a motor 108. The motor 108 and a housing 110 containing the rotatable nut are affixed to a tube 112 into which the threaded rod 106 extends. The tube 112 is attached to the fixed duct 94 by a bracket 113 which allows the tube 112 to pivot relative to the fixed duct 94. Thus, rotation of the motor 108 in one direction causes the threaded rod 106 to be retracted into the tube 112 so that the movable duct 98 is pivoted away from the exhaust manifold portion 88 as shown in solid line in FIG. 4. By so actuating both of the actuators 104, spaces 114 are created between the ends of the movable ducts 98 and the manifold portion 88 allowing the fabric F to be slipped over the end of the dryer roll 26 for removing an old fabric or installing a new one. Rotation of the motors 108 in the opposite direction causes the threaded rods 106 to be extended so that the movable ducts 98 are pivoted back into engagement with the opposite sides of the manifold portion 88. A seal 116 surrounds the periphery of each of the outlets 90 in the manifold portion 88 for sealing the interface with the respective movable duct 98. The seals 116 advantageously comprise "tadpole" gaskets constructed of a core of filamentary stainless steel or the like formed into a resilient pad, and a fabric cover preferably of fiberglass which covers the core. However, various other types of seals can be used.

Figures 4, 5:
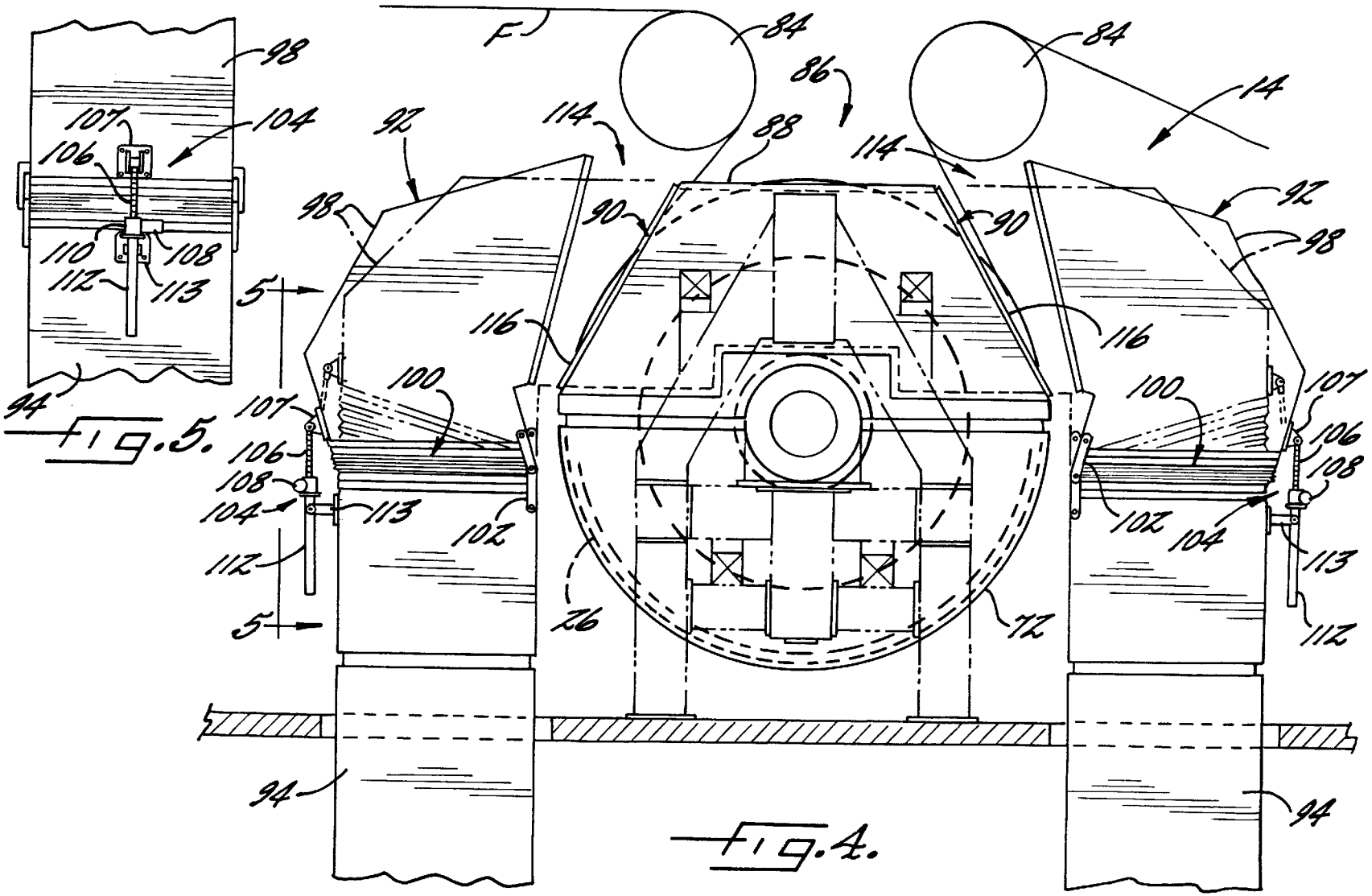
FIG. 4 is an end elevation of the tending side of one of the TAD units of the apparatus of FIG. 1, depicted on an enlarged scale to show the details of the movable exhaust ducts and actuators, the exhaust ducts shown in open positions in solid lines and in closed positions in phantom lines.
FIG. 5 is a side elevation of one of the actuators viewed from line 5—5 of FIG. 4.

In operation, when it is desired to replace the fabric F, the movable ducts 98 for the first and second TAD units 12 and 14 are moved into the open positions as exemplified in FIG. 4. The two halves of each of the supply hoods 18 and 28 are moved apart and away from the respective rolls 16 and 26. Access to the rolls 16 and 26 is thus established so that the old fabric F can be slipped axially off the ends of the rolls at the tending side (and likewise can be disengaged from the guide rolls 76, 78, and 84). A new fabric F is slipped over the ends of the rolls 16 and 26 and over the guide rolls 76, 78, and 84 and over the suction roll 79. The supply hoods 18 and 28 are then moved back into engagement with the rolls 16 and 26, and the movable ducts 98 are pivoted back into the closed positions by operation of the actuators 104, and the apparatus 10 is ready to be operated.

From the foregoing description of preferred embodiments of the invention, it will be appreciated that through-air drying apparatus in accordance with the invention possess advantages in terms of access to the rolls and supply hoods for maintenance purposes. Additionally, the invention facilitates the use of relatively short exhaust ducts which are not routed over the top of a dryer roll, so that pressure losses are minimized and the overall height of the apparatus is not substantially affected by the exhaust system.

Many modifications and other embodiments of the invention will come to mind to one skilled in the art to which this invention pertains having the benefit of the teachings presented in the foregoing descriptions and the associated drawings. For example, while the actuators 104 for moving the exhaust ducts have been described as being motors and jack screws, other types of actuators including other types of motors and gear arrangements, hydraulic actuators, pneumatic actuators, or other equivalent devices may alternatively be used. Moreover, the movable ducts 98 have been described as being pivotally connected to the fixed ducts 94 by bendable bellows 100 and hinges 102, but other types of devices for pivotally connecting the duct sections can be used instead. Furthermore, the movable ducts 98 need not be pivotally movable but may instead be translatable, for example on wheels engaged in a track or other type of device, so that the ducts 98 may be moved away from the exhaust manifold 88 for creating openings to allow removal and replacement of the fabric to be effected. Also, while the TAD units 12 and 14 have been illustrated as being of the inverted type having the supply hood below the rolls, the invention is equally applicable to a TAD unit having the supply hood above the roll. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An apparatus for drying a traveling wet paper web, comprising:

a rotatable roll having a foraminous tubular roll face encircling a rotation axis of the roll and adapted to have the web wrapped over a circumferentially extending active portion thereof, and first and second heads attached to opposite ends of the roll so as to enclose an interior space within the roll, at least the first head of the roll defining an axial air passage therethrough;

a hood surrounding the active portion of the roll and adapted to seal against the roll face such that air flows through the web between the interior of the roll and the hood without substantial leakage therefrom; and a duct system connected to the roll for directing air flow through the web on the roll, the duct system including a pair of ducts fluidly coupled to the axial air passage of the first head, the ducts having elongate portions proximate the first head which extend generally transverse to the rotation axis and which ate spaced apart from each other on opposite sides of the rotation axis such that an access space is defined between the ducts for access to the hood and the roll.

2. The apparatus of claim 1, wherein the hood comprises a supply hood for supplying air to the web on the roll, the axial air passage in the first head comprising an exhaust passage for exhausting air from the interior of the roll, and the ducts comprising exhaust ducts.

3. The apparatus of claim 2, the exhaust system further comprising an exhaust manifold connected to the exhaust passage and located proximate the first head of the roll, the exhaust manifold defining a pair of spaced-apart outlets, and each of the exhaust ducts engaging one of the outlets so as to fluidly couple the exhaust ducts to the exhaust manifold.

4. The apparatus of claim 3, the exhaust system further comprising a pair of spaced-apart fixed ducts each having an open end spaced from one of the outlets of the exhaust manifold, and each of the exhaust ducts having one end pivotally connected to one of the fixed ducts and another end which releasably engages one of the outlets in a closed position of the exhaust duct, the exhaust ducts being pivotable between the closed positions and open positions in which the other ends of the exhaust ducts are moved away from the exhaust manifold and the roll so as to facilitate access to the roll.

5. The apparatus of claim 4, wherein each exhaust duct pivots about a pivot axis that is generally parallel to the rotation axis of the roll.

6. The apparatus of claim 4, wherein the fixed ducts are vertically lower than the rotation axis.

7. The apparatus of claim 4, further comprising a pair of actuators each connected to one of the exhaust ducts, the actuators being operable to pivotally move the exhaust ducts between the open and closed positions.

8. The apparatus of claim 7, wherein each actuator comprises a motor and a gear arrangement which is driven by the motor and which has an element connected to the respective exhaust duct.

9. The apparatus of claim 4, wherein each exhaust duct includes a bendable portion facilitating pivotal movement of the exhaust duct.

10. The apparatus of claim 9, wherein the bendable portions comprise bellows.

11. The apparatus of claim 2, wherein the roll is mounted with the rotation axis thereof generally horizontal, the supply hood covering a bottom dead center portion of the roll, and the exhaust ducts being spaced on opposite sides of the bottom dead center portion of the roll.

12. The apparatus of claim 11, wherein the exhaust ducts extend from proximate the first head of the roll generally vertically downward therefrom.

13. An apparatus for drying a traveling wet paper web, comprising:

a rotatable roll having a foraminous tubular roll face encircling a rotation axis of the roll and adapted to have the web wrapped about a circumferentially extending active portion thereof, and first and second heads attached to opposite ends of the roll so as to enclose an interior space within the roll, the first head including an axial exhaust passage formed therethrough;

a supply hood surrounding the active portion of the roll and adapted to supply air to an outer surface of the web on the roll face; and an exhaust system connected to the roll for exhausting air from the interior thereof such that air from the supply hood is drawn through the web and roll face into the interior of the roll, the exhaust system including an exhaust manifold connected to the exhaust passage and defining at least one outlet proximate the first head, a fixed duct having an open end spaced from the outlet of the exhaust manifold, and a movable duct having one end pivotally connected to the fixed duct and another end releasably engaging the outlet in a closed position of the movable duct, the movable duct being pivotable between the closed position and an open position in which the other end of the exhaust duct is moved away from the exhaust manifold and the roll so as to facilitate access to the roll.

14. The apparatus of claim 13, wherein the exhaust manifold extends generally parallel to the first head of the roll.

15. The apparatus of claim 13, wherein the movable duct includes a bellows facilitating bending of the movable duct.

16. The apparatus of claim 13, wherein the roll is mounted with the rotation axis thereof generally horizontal, a dead zone of the roll which is not surrounded by the supply hood being vertically higher than the rotation axis, and the exhaust manifold being proximate the dead zone.

17. The apparatus of claim 16, wherein the fixed duct is vertically lower than the rotation axis.

18. The apparatus of claim 13, wherein the movable duct pivots about a pivot axis that is generally parallel to the rotation axis of the roll.

19. The apparatus of claim 13, further comprising an actuator connected to the movable duct and operable to pivotally move the movable duct between the open and closed positions.

20. The apparatus of claim 19, wherein the movable duct is spaced from the rotation axis of the roll by at least about half of an outer diameter of the roll.

21. An exhaust system for a through-air drying apparatus of the type including a rotatable roll having a foraminous tubular roll face about which a wet paper web is wrapped and through which air is forced into an interior of the roll for drying the web, and in which air is exhausted from the roll through at least one exhaust passage formed through an head of the roll, the exhaust system comprising:

an exhaust manifold connected to the exhaust passage and defining at least one outlet proximate the head;

at least one fixed duct having an open end spaced from the outlet of the exhaust manifold; and at least one movable duct having one end pivotally connected to the fixed duct and another end releasably engaging the outlet in a closed position of the movable duct, the movable duct being pivotable between the closed position and an open position in which the other end of the exhaust duct is moved away from the exhaust manifold and the roll so as to facilitate access to the roll.

22. The apparatus of claim 21, wherein the movable duct pivots about a pivot axis that is generally parallel to a rotation axis of the roll.

23. The apparatus of claim 21, wherein the fixed duct is vertically lower than a rotation axis of the roll.

24. The apparatus of claim 21, further comprising an actuator connected to the movable duct, the actuator being operable to pivotally move the movable duct between the open and closed positions.

25. The apparatus of claim 24, wherein the actuator comprises a motor and a gear arrangement which is driven by the motor and which has an element connected to the movable duct.

26. The apparatus of claim 21, wherein the movable duct includes a bendable portion facilitating pivotal movement of the movable duct.

27. The apparatus of claim 26, wherein the bendable portion comprises a bellows.

28. The apparatus of claim 21, wherein the exhaust manifold defines two outlets, and further comprising another movable duct and another fixed duct, each of the two movable ducts being pivotally connected at one end to one of the two fixed ducts, the other ends of the movable ducts releasably engaging the outlets in the exhaust manifold.

* * * * *

UNITED STATES PATENT AND TRADEMARK OFFICE
CERTIFICATE OF CORRECTION

PATENT NO. : 6,079,116

DATED : June 27, 2000

INVENTOR(S) : Jewitt et al.

It is certified that error appears in the above-identified patent and that said Letters Patent is hereby corrected as shown below:

Title page, [56] References Cited, U.S. PATENT DOCUMENTS, line 14, "IIvespaa et al." should read --Ilvespaa et al.--; line 17, "Ilmarinen et al." should read --Ilmarinen--; lines 20 and 26, "IImarinen et al." should read --Ilmarinen--.

Column 9, line 26, "ate" should read --are--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*